US007248714B2

(12) United States Patent
Tsuda

(10) Patent No.: US 7,248,714 B2
(45) Date of Patent: Jul. 24, 2007

(54) MICRO-SPEAKER AND METHOD FOR ASSEMBLING A MICRO-SPEAKER

(75) Inventor: Shiro Tsuda, Asahi (JP)

(73) Assignee: Ferrotec Corporation, Tokyo (JP)

( * ) Notice: Subject to any disclaimer, the term of this patent is extended or adjusted under 35 U.S.C. 154(b) by 400 days.

(21) Appl. No.: 10/874,105

(22) Filed: Jun. 22, 2004

(65) Prior Publication Data

US 2004/0234096 A1 Nov. 25, 2004

Related U.S. Application Data

(62) Division of application No. 10/121,129, filed on Apr. 11, 2002, now Pat. No. 6,804,368.

(51) Int. Cl.
*H04R 25/00* (2006.01)

(52) U.S. Cl. ..... 381/415; 381/412

(58) Field of Classification Search ..... 381/396, 381/400, 412, 413, 415; 29/594
See application file for complete search history.

(56) References Cited

U.S. PATENT DOCUMENTS

| | | | | | |
|---|---|---|---|---|---|
| 4,017,694 | A | * | 4/1977 | King | 381/415 |
| 4,303,806 | A | * | 12/1981 | Thiele | 381/410 |
| 4,320,263 | A | * | 3/1982 | Thiele | 381/415 |
| 4,414,437 | A | * | 11/1983 | Trauernicht et al. | 381/415 |
| 4,742,887 | A | * | 5/1988 | Yamagishi | 181/129 |
| 5,243,662 | A | * | 9/1993 | Sogn et al. | 381/420 |
| 5,335,287 | A | * | 8/1994 | Athanas | 381/415 |
| 5,757,946 | A | * | 5/1998 | Van Schyndel | 381/412 |

* cited by examiner

*Primary Examiner*—Suhan Ni
(74) *Attorney, Agent, or Firm*—Robert R Deleault; Mesmer & Deleault, PLLC

(57) ABSTRACT

The micro-speaker includes a driver unit having a housing, a magnet disposed within the housing forming a radial gap between the magnet and the circumferential walls of the housing, and a magnetic plate disposed on the magnet, a vibration system having a diaphragm and a voice coil where the vibration system is fixed to the drive unit and the voice coil protrudes into the radial gap, and a volatile magnetic fluid in the radial gap about the voice coil.

6 Claims, 2 Drawing Sheets

MICRO-SPEAKER AND METHOD FOR ASSEMBLING A MICRO-SPEAKER

This application is a Divisional application of Ser. No. 10/121,129, filed on Apr. 11, 2002 now U.S. Pat. No. 6,804,368.

BACKGROUND OF THE INVENTION

1. Field of the Invention

The present invention relates generally to an apparatus and method for audio speakers. Particularly, this invention relates to a micro-speaker and a method of assembling micro-speakers using a liquid suspension mechanism.

2. Description of the Related Art

Conventional speakers commonly comprise a magnet assembly, and a non-magnetic, annular frame extending from the magnet assembly to support the larger end of a cone-shaped diaphragm. The smaller end of the diaphragm cone is attached to a voice coil that extends into an annular magnetic gap provided in the magnet assembly. In order to accurately locate and suspend the voice coil within the magnetic gap, the voice coil is typically attached to the surrounding frame by a corrugated annular suspension.

The voice coil is designed to oscillate axially without experiencing other types of motion such as rotation, moving obliquely to the axial direction, or moving in different directions, at different points, in the oscillation stroke. Should the voice coil scrape on the magnetic gap surfaces, the coil will experience premature failure. One solution is the use of a low volatile, oil-based, magnetic liquid suspension mechanism for locating and suspending the voice coil within the magnetic gap. The oil-based magnetic particle colloid is adhered to the voice coil and to the magnetic gap surfaces since the microscopic magnetic particles are magnetically attracted to the gap surfaces by reason of the permanent magnetic field established across the magnetic gap. The microscopic, i.e. approximately 0.01 micrometers, magnetic particles hold the liquid phase of the colloid in the magnetic gap.

The use of low volatile, oil-based, magnetic fluid in the magnetic gap, however, is not without problems. One problem is the tendency for the liquid to be blown out or drawn out of the magnetic gap during operation, thereby depleting the quantity of liquid in contact with the voice coil. This phenomenon is due to the oscillatory motions of the voice coil, which produces momentary pressure changes in the atmosphere near the end of the pole pieces and in the annular chamber surrounding the pole piece. The use of pressure compensating channels or passageways has been used to prevent this potential blow out problem. Another problem is the added cost of using specially-formulated, low volatile, oil-based magnetic fluids as the locating and suspending mechanism.

Speaker manufacturers have constantly attempted to reduce the size of loudspeakers for use in miniaturized devices such as headphones, hearing aids, cellular phones, etc. U.S. Pat. No. 5,243,662 (1993, Sogn et al.) is one example of these miniature or micro-speaker devices. It discloses a miniaturized electrodynamic sound generator having a diaphragm, a permanent magnet with pole pieces, a magnet yoke, and a coil. The coil is attached to near the margins of the diaphragm and, on the outside of the yoke, the diaphragm is bent down and attached to the outer wall of the yoke.

U.S. Pat. No. 4,742,887 (1988, Yamagishi) discloses an earphone having a housing containing a driver unit. The driver unit includes a magnetic circuit formed by a magnetic plate, a yoke and a magnet, and a vibration system formed of a diaphragm and a voice coil that is accommodated in a gap between the yoke and the magnet. The driver unit extends across the housing adjacent a sound generation opening at the front of the housing so as to divide the interior of the housing into a front cavity and a back cavity.

U.S. Pat. No. 4,320,263 (1982, Thiele) discloses a dynamic electroacoustic transducer having a magnetic pole case defining a magnetic air gap, a coil movably mounted in the air gap and spaced from the magnetic pole case with magnetic liquid extending between the coil and the case in the air gap. A diaphragm is connected to the coil and attached peripherally to the magnetic pole casing so that airtight spaces are defined above and below the coil, which are in communication with each other. The airtight sealing of the spaces prevents the liquid portions of the magnetic liquid from evaporating, which would result in deterioration of the characteristics of the dynamic electroacoustic transducer.

U.S. Pat. No. 5,335,287 (1994, Athanas) discloses a loudspeaker with an oil-based magnetic fluid suspension for the voice coil, instead of the corrugated disk suspension that is conventionally used. Specially designed vent passages are formed in the magnet assembly to prevent internal pressure build-ups, or sub-atmospheric conditions, that could cause the magnetic fluid to be blown out of the magnetic gap.

Due to market-driven cost constraints, manufacturers of micro-speakers for use in cellular phones and other widespread, consumer electronics have designed micro-speakers that do not use the corrugated mechanism for centering and locating the voice coil in the magnetic gap. A magnetic fluid mechanism for centering and locating the voice coil in the magnetic gap of a micro-speaker is also not used because the magnetic fluid reduces, i.e. dampens, the sound pressure too much in these small-sized speakers. Consequently, the voice coil is centered and suspended in the magnetic gap without the use of these two particular centering mechanisms.

The size of the micro-speakers also creates a problem for manufacturers during the assembly process. Currently, manufacturers of micro-speakers experience a micro-speaker rejection rate that is relatively high. One of the reasons for such a rejection rate is that the assembly process is a manually intensive process. The main causes of the failure is breaking of the wire, which has a typical diameter of about 0.008 in. (0.2 mm) to about 0.013 in. (0.33 mm), that attaches to the monolithic coil, deformation of the magnetic pole piece as it is an extremely thin metal plate, and touching of the wire to the yoke when the coil, which is attached to the diaphragm, is inserted into the magnetic gap of the speaker and fixed in place.

Therefore, what is needed is an assembly method that allows the voice coil to be easily centered and suspended during the manufacturing process. What is also needed is an assembly method that reduces the manufacturing process rejection rate. What is further needed is an assembly method that is inexpensive to use and whose cost is more than offset by the reduction in the failure rate during micro-speaker production.

SUMMARY OF THE INVENTION

It is an object of the present invention to provide a micro-speaker and a method of manufacturing micro-speakers that is inexpensive to implement. It is another object of the present invention to provide a method of manufacturing micro-speakers that locates and centers the voice coil in the magnetic gap during the assembly of the diaphragm/voice coil assembly to the yoke assembly. It is still another object of the present invention to provide a method of manufacturing micro-speakers that reduces the failure rate of micro-speakers during micro-speaker production.

The present invention achieves these and other objectives by providing a simple method and mechanism for locating and centering the voice coil of a micro-speaker into the magnetic gap of the driver unit of the micro-speaker during the assembly process. The method includes the step of adding a predetermined amount of a volatile magnetic fluid to the magnetic gap before inserting the voice coil into the magnetic gap. The volatile magnetic fluid locates and centers the voice coil in the magnetic gap during the assembly process. Once the voice coil and diaphragm are fixed to the support structure of the micro-speaker in such a way that evaporation of the magnetic fluid is permitted, the magnetic fluid is evaporated leaving an air gap between the voice coil and the magnetic pole pieces of the micro-speaker.

Unlike oil-based magnetic fluids that typically use a low volatile carrier liquid such as a hydrocarbon oil, the volatile magnetic fluid of the present invention is one having a relatively volatile carrier base liquid. The volatile carrier liquid typically is a volatile liquid that is capable of undergoing evaporation at room temperature or at elevated temperatures below those required for oil-based carrier liquids. Examples of volatile liquids are water and aliphatic hydrocarbon solvents such as octane, heptane and hexane. Generally, the saturation magnetization is as low as possible for use as a voice coil centering mechanism for a given speaker configuration so as not to form a thick residual layer of magnetic particles on the voice coil or the pole pieces.

The method of the present invention involves obtaining a volatile magnetic fluid and adding a predetermined amount of the volatile magnetic fluid to the magnetic gap of the micro-speaker. The volatile magnetic fluid may be added using a dispenser or by dipping a solid needle rod or a hollow rod (i.e. capillary tube) into the magnetic fluid and locating the solid rod, the hollow rod or the dispenser close to the magnetic gap. The wetting ability of the ferrofluid and the magnetic force field of the driver unit cause the volatile magnetic fluid to fill the magnetic gap of the micro-speaker. The voice coil of the diaphragm/voice coil assembly is then positioned over the centrally-located yoke, i.e. pole piece, and the voice coil is inserted into the magnetic gap. The volatile magnetic fluid will become disposed around the voice coil causing the voice coil to be located and centered within the magnetic gap. The diaphragm/voice coil assembly can then be secured into position. Once secured, the volatile magnetic fluid is evaporated leaving the voice coil suspended within the magnetic gap.

DETAILED DESCRIPTION OF THE PREFERRED EMBODIMENT

Figure 1:
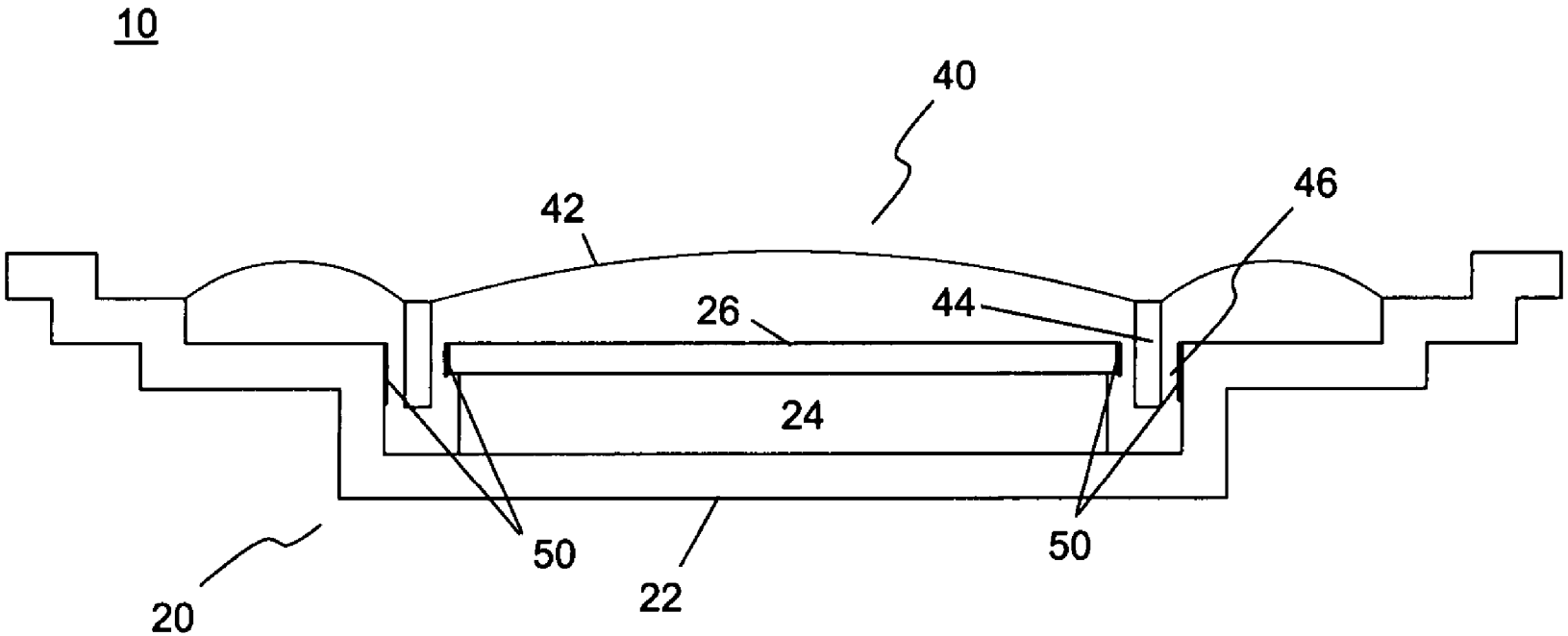
FIG. 1 is a simplified cross-sectional view of a micro-speaker.

The preferred embodiment of the present invention is illustrated in

FIGS. 1-5. Now turning to FIG. 1, there is shown a simplified cross section of a micro-speaker 10. Micro-speaker 10 includes a driver unit 20 and a vibration system 40. Driver unit 20 includes a magnetic circuit formed by a support frame or yoke 22, a magnet 24, and a magnetic plate 26. Vibration system 40 is formed of and includes a diaphragm 42 and a voice coil 44. Voice coil 44 is accommodated in a radial gap 46 formed by yoke 22, magnet 24 and magnetic plate 26. Voice coil 44 and radial gap 46 have a residue 50 on various surfaces caused by the evaporation of a volatile magnetic fluid.

Micro-speaker 10 is a low profile speaker typically for use in cellular phones and the like. For a better understanding of the importance of the present invention, a listing of typical dimensions of a currently available micro-speaker is provided. Magnetic plate 26 is in the shape of a disk having a diameter of about 7.9 mm with a thickness of about 0.4 mm. Magnet 24 is also disk-shaped having a diameter of about 7.4 mm with a thickness of about 0.6 mm. Support frame or yoke 22 forms a housing for magnet 24 and magnetic plate 26 that provides a radial gap 46 of about 0.75 mm. The radial gap volume is about 8.15 $mm^3$. Voice coil 44 has an internal diameter of about 8.3 mm with an outer diameter of about 8.7 mm forming a voice coil volume in radial gap 46 of about 2.14 $mm^3$.

From the above-described, typical dimensions for a micro-speaker, it is understandable that speaker manufacturers have a relatively high rejection rate in manufacturing. The close specifications of the voice coil 44 within radial gap 46 and the size of micro-speaker 10 makes handling of driver unit 20 and vibration system 40 difficult and tedious. This causes breaking of the wires that attach to voice coil 44, deformation of magnetic plate 26, and/or contacting of the voice coil 44 to the yoke 22 when vibration system 40 is assembled to driver unit 20.

The present invention provides a method for locating and centering voice coil 44 within radial gap 46 during the assembly process. The method of the present invention includes the use of a volatile magnetic fluid. The volatile magnetic fluid generally comprises a volatile carrier liquid or base liquid, a plurality of magnetic particles, and a dispersant for dispersing the plurality of magnetic particles in the volatile carrier liquid. Some useful carrier liquids are water and aliphatic hydrocarbons such as hexane, heptane and octane. Any conventional magnetic fluid based on volatile liquids as the carrier liquid may be used and the formulations of such volatile magnetic fluids are within the knowledge of one of ordinary skill in the art. Although aromatic hydrocarbon and other polar solvents may be used as the base carrier liquid, it is hypothesized that use of these types of liquids may affect the integrity of adhesives used, if any, in the micro-speaker.

Figure 2:
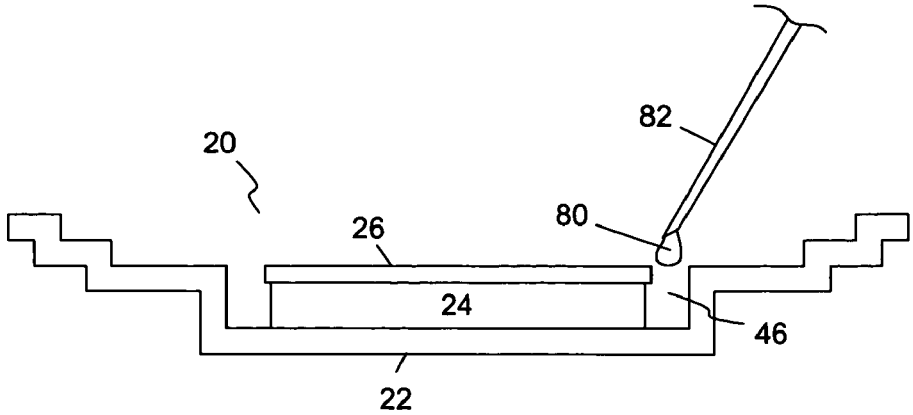
FIG. 2 is a simplified cross-sectional view of the support structure of a micro-speaker.

Turning now to FIGS. 2-5, there is shown the method of the present invention. FIG. 2 illustrates the driver unit 20 of a microspeaker 10 having a magnetic circuit formed by a support frame or yoke 22, a magnet 24, and a magnetic plate 26. A predetermined amount, typically only a few microliters or less, of volatile magnetic fluid 80 is added to the radial gap 46. Magnetic fluid 80 may be added using a dispenser with a needle-shaped tip 82 or by simply dipping a properly-sized needle rod into the bulk magnetic fluid and then locating the needle rod having a drop or droplet on the rod's tip close to radial gap 46, transferring the drop or droplet of volatile magnetic fluid to radial gap 46. It is noted that a properly sized capillary tube may be substituted for the needle rod.

Figure 3:
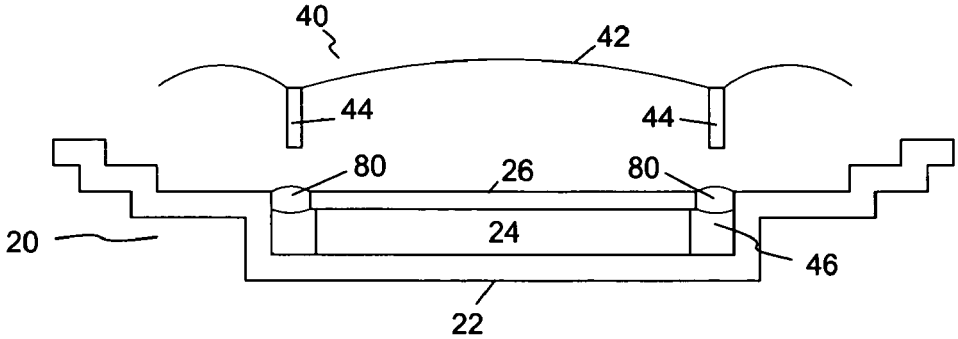
FIG. 3 is a simplified cross-sectional view of the support structure of a micro-speaker with the volatile magnetic fluid in the magnetic gap.
Figure 4:
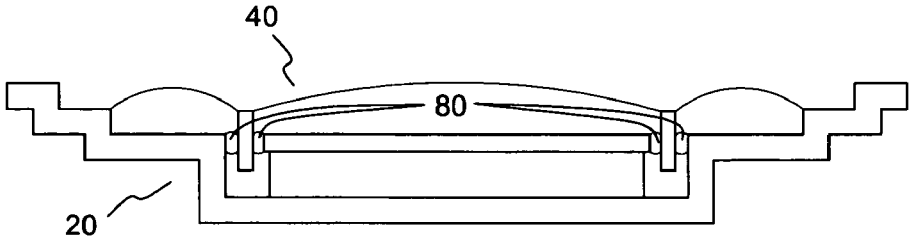
FIG. 4 is a simplified cross-sectional view of an assembled micro-speaker with the volatile magnetic fluid in the magnetic gap around the voice coil.

FIG. 3 illustrates the location of the volatile magnetic fluid 80 in the radial gap 46. Vibration system 40 having diaphragm 42 and voice coil 44 is positioned over drive unit 20 such that voice coil 44 is aligned with radial gap 46 formed by yoke 22, magnet 24 and magnetic plate 26. Once aligned, vibration system 40 is placed into position. FIG. 4 illustrates vibration system 40 positioned into drive unit 20. Volatile magnetic fluid 80, because of the magnetic force field established by magnet 24 with yoke 22 and magnetic plate 26, locates and centers voice coil 44 in radial gap 46. Vibration system 40 is now fixed in position to driver unit 20.

Figure 5:
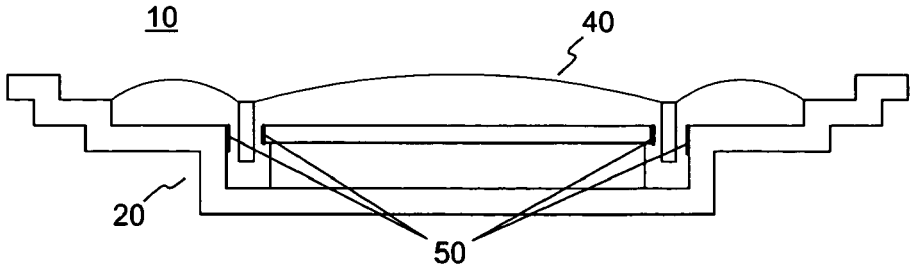
FIG. 5 is a simplified cross-sectional view of an assembled micro-speaker after the volatile magnetic fluid in the magnetic gap has been evaporated.

After vibration system 40 is fixed in position to driver unit 20, volatile magnetic fluid 80 is evaporated from micro-speaker 10 as shown in FIG. 5. Although the volatile base carrier liquid is evaporated, a residual layer 50 is left behind on the surfaces of radial gap 46. Residual layer 50 comprises the plurality of magnetic particles from the evaporated volatile magnetic fluid.

The quantity of magnetic particles per unit volume of magnetic fluid is represented by the magnetic fluid's saturation magnetization and it is measured in Gauss. A low saturation magnetization fluid tends to leave a thinner residual layer of magnetic particles than a magnetic fluid with a higher saturation magnetization. However, either one may be used depending on the manufacturing procedure used. Using a magnetic fluid with a low saturation magnetization allows for filling of the magnetic gap with the fluid for centering the voice coil, but may require the fixing of the diaphragm either temporarily or at intermittent locations so as to provide a means for the volatile liquid vapor to escape from the radial gap. Those skilled in the art of speaker assembly are better able to determine without undue experimentation the most economical assembly procedure for using the method of the present invention with a volatile magnetic fluid having a low saturation magnetization.

Using a magnetic fluid with a higher saturation magnetization allows for incomplete filing of the radial gap forming an incomplete liquid O-ring with air passages but provides a stronger magnetic centering force. The air passages would act as a conduit allowing the volatile liquid vapor of the magnetic fluid to escape the radial gap. Preferably, the saturation magnetization range for use in the present invention is kept reasonably low so as not to form a relatively thick residual layer of magnetic particles on voice coil 44 and/or magnetic plate 26. It should be understood that the proper saturation magnetization for a given volatile magnetic fluid composition will be dependent of a variety of factors including the type of carrier liquid used as the base volatile liquid in the volatile magnetic fluid, the size of the speakers, the size of the radial gap, the clearances between the voice coil and the radial, etc.

Tests were performed on representative samples of magnetic fluids to determine the approximate amount of magnetic particles that would be left behind after evaporation. Two types of magnetic fluids using heptane as the volatile carrier liquid were prepared. The preparation of these magnetic fluids was prepared in the conventional manner known by those of ordinary skill in the art. In the first example, oleic acid was used as the dispersant and the excess amount of the oleic acid was removed. In the second example, oleic acid was used as the dispersant and some of the excess oleic acid (about 5 vol. %) was left in the magnetic fluid. Each type of magnetic fluid was separated into various samples and the saturation magnetization for each sample was adjusted. The collection of samples represented magnetic fluid of each type having a saturation magnetization of 50, 100, 200, and 400 Gauss.

A test fixture was prepared that consisted of a magnetic housing, a magnet, a spacer, a sleeve, and a top magnetic plate. The test fixture was similar to a dome tweeter speaker without the coil or diaphragm. The radial gap volume for the test fixture was about 116 $mm^3$. Each kind of magnetic fluid having the different saturation magnetization values was injected into the radial gap of the test fixture. A volume of about 120 $mm^3$ was injected for each test. The volatile base carrier liquid was removed by evaporation and the condition of the residual magnetic particles in the radial gap was observed.

The 100 Gauss magnetic fluid having the oleic acid dispersant/surfactant and containing no excess dispersant/surfactant formed about 0.09 mm of residual layer outside of the magnetic plate 26 and about 0 mm to about 0.01 mm of residual layer in the inside of the radial gap 46. The residual layer appeared crisp, cracked and not sticky. The 100 Gauss magnetic fluid having the oleic acid dispersant and containing about 5 vol. % of excess of the oleic acid dispersant/surfactant to the volume of ferrofluid formed about 0.25 mm of residual layer outside of the magnetic plate 26 and about 0 to about 0.01 mm of residual layer in the inside of the radial gap 46. The residual layer appeared very sticky. The results tend to indicate that the surfactant used to disperse the plurality of magnetic particles in the volatile base carrier liquid is preferably one having a relatively short molecular tail like that of oleic acid with the excess surfactant preferably removed from the magnetic fluid. Even though the radial gap volume of the test fixture was approximately 14 times larger than the radial gap volume in a micro-speaker, it is expected that the volume of magnetic fluid used and the resulting residual layer of magnetic particles will also be proportionally less than was observed with the test fixture using comparable Gauss-valued, volatile magnetic fluids, and likely less because the radial gap of the micro-speaker is likely less than the radial gap of a dome tweeter speaker and because the volume taken up by the voice coil will also reduce the amount of volatile fluid left in the radial gap before the evaporation step.

Another formulation of the volatile magnetic fluid may include a quantity of adhesive. Even though the magnetic force field attracts and holds the magnetic particles, i.e. the residual layer, on the walls of the yoke and the magnetic plate after evaporation of the volatile liquid carrier, mixing a quantity of adhesive in the volatile magnetic fluid would insure fixing of the magnetic particles/residual layer after evaporation. This would be in addition to the effect of the magnetic force holding the particles/residual layer in position.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A micro-speaker comprising:

a driver unit having a support frame with a central portion forming a housing, a magnet secured on one end to a bottom of said housing such that a radial gap is formed between said magnet and a circumferential wall of said housing, and a magnetic plate secured to the other end of said magnet;

a vibration system having a diaphragm and a voice coil attached to one side of said diaphragm wherein said vibration system is fixed to said driver unit and said voice coil is suspended in said radial gap; and a volatile magnetic fluid temporarily disposed in said radial gap about said voice coil, said volatile magnetic fluid having a volatile carrier liquid.

2. The micro-speaker of claim 1 wherein said volatile carrier liquid is one or more of water, aliphatic hydrocarbon, aromatic hydrocarbon, and other polar solvent.

3. The micro-speaker of claim 2 wherein said aliphatic hydrocarbon is selected from the group consisting of hexane, heptane and octane.

4. The micro-speaker of claim 1 wherein said volatile magnetic fluid includes a volatile carrier liquid, a plurality of magnetic particles and a sufficient quantity of dispersing agent to disperse said plurality of magnetic particles in said volatile carrier liquid.

5. The micro-speaker of claim 1 wherein said volatile magnetic fluid has a saturation magnetization sufficiently low to minimize the quantity of residual magnetic particles after removal of said volatile carrier liquid but high enough to interact with a magnetic field generated within said radial gap by said housing, said magnet and said magnetic plate for centering said voice coil in said radial gap.

6. The micro-speaker of claim 5 wherein said volatile magnetic fluid further includes an adhesive.

* * * * *